US006797297B2

(12) United States Patent
Schneider

(10) Patent No.: US 6,797,297 B2
(45) Date of Patent: Sep. 28, 2004

(54) INDICATING DEVICE AND METHOD FOR OPERATING SUCH A DEVICE

(75) Inventor: Ralf Schneider, Stein (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 287 days.

(21) Appl. No.: 10/137,907

(22) Filed: May 3, 2002

(65) Prior Publication Data

US 2002/0189464 A1 Dec. 19, 2002

(30) Foreign Application Priority Data

May 3, 2001 (DE) ..... 101 21 534

(51) Int. Cl.[7] ..... G06G 7/00; G01K 1/00

(52) U.S. Cl. ..... 426/231; 219/445.1; 219/627; 340/584; 340/588; 374/102; 377/25; 426/233

(58) Field of Search ..... 426/231, 233, 426/523; 99/342; 219/445.1, 462.1, 627; 340/584, 588; 374/102, 103; 377/25

(56) References Cited

U.S. PATENT DOCUMENTS 4,413,175 A 11/1983 Schilling et al. ..... 377/25
5,103,077 A * 4/1992 Goessler et al. ..... 219/445.1
5,283,412 A * 2/1994 Gouardo et al. ..... 219/627
6,087,944 A * 7/2000 Santacatterina et al. .... 340/588

FOREIGN PATENT DOCUMENTS

| | | |
|---|---|---|
| DE | 30 03 419 A1 | 8/1981 |
| DE | 31 18 414 C2 | 11/1982 |
| DE | 199 23 995 A1 | 11/2000 |
| DE | 199 25 228 A1 | 12/2000 |
| EP | 0 033 499 A2 | 8/1981 |

* cited by examiner

*Primary Examiner*—George C. Yeung
(74) *Attorney, Agent, or Firm*—Laurence A. Greenberg; Werner H. Stemer; Ralph E. Locher

(57) ABSTRACT

An electrical cooking appliance has at least one cooktop with cooking zones becoming hot in a switched-on state, an optical residual heat indicator indicating hot cooking zones when line voltage is applied to the cooking appliance, a counter system switching off the residual heat indicator with a time delay after the switching-off of the cooking appliance connected to line voltage occurs, and a line voltage detector for detecting a presence of the line voltage at the cooking appliance. Information is stored in a memory of the counter system as long as a counter reading is greater than zero, and, after a line voltage interruption, the residual heat indicator remains activated for a certain period of time, in dependence on the inquired memory content, if the information in the memory indicates a counter value greater than zero.

25 Claims, 1 Drawing Sheet

INDICATING DEVICE AND METHOD FOR OPERATING SUCH A DEVICE

BACKGROUND OF THE INVENTION

Field of the Invention

The present invention relates to an indicating device, in particular, a residual heat indicator of an electrical cooking appliance.

Electrical cooking appliances, in particular those, with a cooktop or cooking zones of a non-metallic material, such as of glass ceramic, for example, typically have a residual-heat warning device. As long as the cooking appliance is connected to line voltage, the warning device outputs a warning signal if the surface temperature of a cooking zone lies above the value critical for physical contact. As such, the risk of being burnt as a result of touching heated surfaces of the cooktop is reduced. Because the cooktop still remains hot for a certain period of time even after the cooking appliance has been operationally switched off, it is advisable for the residual heat indicator to continue to output the warning signal even after the cooking appliance has been switched off until the cooktop has cooled down. Direct sensing of the temperature of the cooktop by a temperature sensor would be possible, but is relatively complicated and cost-intensive. In an alternative method of sensing the temperature of the cooktop, corresponding to European Patent Application 0 033 499 A, corresponding to U.S. Pat. No. 4,413,175 to Schilling et al., a counter is set based upon empirically determined cooling times to a starting value in dependence on the switching-on stage or power stage and the time for which the cooking appliance has been switched on. After the cooktop is switched off, the counter counts backward from its current starting value to zero. As soon as the zero value is reached, the residual-heat warning device is switched off. A disadvantage of such a configuration is the volatility of the counter starting value, for example, when there is an interruption in the line voltage as in the event of a power failure. In such a case, the counter is set to zero, and consequently the residual-heat warning device is switched off even though, under some circumstances, the cooktop is still in a hot state.

In the case of another prior art residual-heat warning device corresponding to German Published, Non-Prosecuted Patent Application DE 199 25 228 A, a line interruption or power failure is also taken into account, in that a line voltage detector, which detects the presence of the line voltage at the cooking appliance, is provided in addition to the residual heat indicator. After a line voltage interruption, the residual-heat warning device outputs a special warning signal that indicates a prior power failure.

SUMMARY OF THE INVENTION

It is accordingly an object of the invention to provide a residual-heat warning device for a cooking appliance that overcomes the hereinafore-mentioned disadvantages of the heretofore-known devices and methods of this general type and that permits a reliable indication of the residual heat of a cooktop even in the event of line voltage interruptions.

With the foregoing and other objects in view, there is provided, in accordance with the invention, an electrical cooking appliance to be connected to a line voltage includes a cooktop having cooking zones becoming hot in a switched-on state, at least one optical residual heat indicator indicating hot ones of the cooking zones when the line voltage is applied to the cooking appliance, the heat indicator connected to the cooking zones, a counter having a memory storing at least one of a time delay value and a counter reading, the counter connected to the heat indicator, the counter being programmed to switch off the heat indicator at a time after the cooktop is switched off, the time being dependent upon the time delay value, the memory storing information as long as the counter reading is greater than zero, a line voltage detector for detecting a presence of the line voltage at the cooking appliance, and the counter being programmed to activate, after a line voltage interruption, the heat indicator for a given period of time dependent upon a content of the memory if the information in the memory indicates the counter reading is greater than zero.

The electrical cooking appliance according to the invention has the advantage of a reliable residual heat indication even after a prior line voltage interruption, for example, due to a power failure. As a result, unlike in the case of prior art residual heat indicators, optical and/or acoustic devices can reliably warn against touching the still hot cooking zones in virtually all cases.

In accordance with another feature of the invention, the line voltage detector is connected to the heat indicator and to the counter.

In accordance with a further feature of the invention, at least two counter readings are stored in the memory as long as the counter reading is greater than zero. Such a configuration has the accompanying advantage that a reliable estimate of the still remaining duration of residual heat is made possible.

In accordance with an added feature of the invention, there is provided a button for manually switching off the power failure warning signal of the residual heat indicator. Such an embodiment has the advantage that a manual correction of the residual heat indication is possible at any time. It is consequently possible, for example, for the residual heat indicator to be reset before switching a cooktop on again, in order to have the indication activated again for a certain period of time by the counter after the switching-off of the cooktop.

In accordance with an additional feature of the invention, the residual heat indicator can output a visual and/or acoustic signal after a line voltage interruption, which has the accompanying advantage of conspicuous and/or loud signaling of residual heat. Such an embodiment ensures, to a great extent, that attention is attracted.

With the objects of the invention in view, there is also provided an electrical cooking appliance to be connected to a line voltage including a cooktop having cooking zones becoming hot in a switched-on state, at least one optical residual heat indicator indicating hot ones of the cooking zones when the line voltage is applied to the cooking appliance, the heat indicator electrically connected to the cooking zones, a counter system having a memory storing a time delay counter value, the counter system connected to the heat indicator, the counter system being programmed to switch off the heat indicator at a given time after the cooktop is switched off, the given time being dependent upon the counter value and to decrement the counter value to zero, the memory storing information as long as the counter value is greater than zero, a line voltage detector for detecting a presence of the line voltage at the cooking appliance, the line voltage detector electrically connected to the heat indicator and to the counter, and the counter system being programmed to activate, after a line voltage interruption, the heat indicator for a given period of time dependent upon a content of the memory if the information in the memory indicates the counter value is greater than zero.

With the objects of the invention in view, there is also provided a method of operating a residual heat indicator of an electrical cooking appliance, including the steps of sensing a switched-on state of the cooking appliance, sending a residual heat warning signal from the residual heat indicator as long as the cooking appliance has a line voltage applied, establishing a delay interval value with a counter system, after switching-off the cooking appliance connected to the line voltage, switching off the residual heat indicator with the counter system at a later point in time dependent upon the delay interval value, detecting a presence of the line voltage at the cooking appliance with a line voltage detector, decrementing the delay interval value with the counter system, storing information in a memory of the counter system as long as the delay interval value is greater than zero, and after interruption of the line voltage, maintaining activation of the residual heat indicator as long as the delay interval value is greater than zero.

The method according to the invention has the advantage of providing a reliable residual heat indication even after a prior line voltage interruption, whereby an optical and/or acoustic device can reliably warn against touching the still hot cooking zones in almost all cases that occur.

In accordance with yet another mode of the invention, at least two counter readings are stored in the memory as long as the counter reading is greater than zero. Such a mode has the accompanying advantage of a more reliable estimate of the still remaining duration of residual heat.

In accordance with yet a further mode of the invention, the values of the counter are stored at regular intervals and, after a line voltage interruption, are used for the time-delayed switching-off of the residual heat indicator and/or for the output of a power failure warning signal. Such a mode according to the invention has the advantage of providing a very reliable determination of the duration of residual heat based upon the stored counter values, which leads to a relatively exact match between the residual heat indication and the actual time period for which the cooktop is hot.

In accordance with yet an added mode of the invention, there is provided, in an EEPROM of the memory, a residual heat flag that can assume two different states and, after the duration of residual heat has elapsed, the residual heat indicator is deactivated and the residual heat flag is cleared. Such a configuration can constitute a very low-cost and, at the same time, a very reliable protective function that can provide a residual heat indication even after a line voltage interruption.

In accordance with yet an additional mode of the invention, after a line voltage interruption, an inquiry of the residual heat flag is provided, that a preloading of the counter with a meaningful value is provided, and that, after the duration of residual heat has elapsed, the residual heat flag is cleared. Preloading with an empirically determined meaningful preloading value of the counter provides a better match of the actual duration of residual heat with the duration of the indication of the residual heat indicator.

In accordance with again another mode of the invention, the counter reading is stored at regular intervals in the EEPROM. Moreover, after a line voltage interruption, there is an inquiry of the memory value of the EEPROM, after which renewed initialization of the counter takes place based upon the memory value of the EEPROM. Such a mode according to the invention has the accompanying advantage of a relatively good match between the actual duration of residual heat and the duration of residual heat predicted by the residual heat indicator. The configuration all but rules out the risk of a residual heat indicator already being switched off while a cooktop is still hot.

In accordance with again a further mode of the invention, the residual heat indicator outputs a flashing signal after a line voltage interruption, with the accompanying advantage of increasing the signaling effect on account of the visually conspicuous signal.

In accordance with again an added mode of the invention, the residual heat indicator outputs an acoustic signal after a line voltage interruption. The output has the accompanying advantage of a yet greater increase in the signaling effect for an operator.

In accordance with a concomitant mode of the invention, after renewed switching-on of the cooking appliance, the residual heat indicator is switched off. Such a mode has the advantage that renewed initialization of the counter is made possible so that the residual heat indicator reliably indicates the residual heat again after switching-off of the cooking appliance. Moreover, when an appliance is switched on again, the residual heat indicator is generally no longer required.

Other features that are considered as characteristic for the invention are set forth in the appended claims.

Although the invention is illustrated and described herein as embodied in an indicating device and method for operating such is a device, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
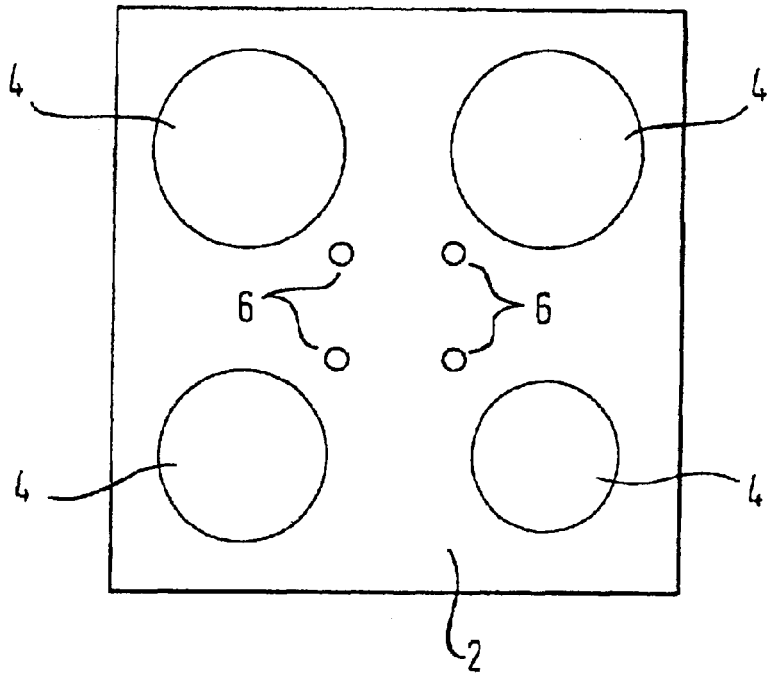
FIG. 1 is a diagrammatic plan view of an oven cooktop with a residual heat indicator according to the invention.

Referring now to the figures of the drawings in detail and first, particularly to FIG. 1 thereof, there is shown a plan view of a cooktop 2 of a cooking appliance or an oven with, in the example illustrated, four cooking zones 4. The cooktop 2 preferably a conventional glass ceramic cooktop with a planar surface. Disposed underneath the class ceramic panel of the cooktop 2 are four conventional, controllable heating elements, which are not illustrated in the representation shown. Each cooking zone 4 is associated with a residual heat indicator 6, for example, in the form of a light-emitting diode disposed underneath the class ceramic panel.

Figure 2:
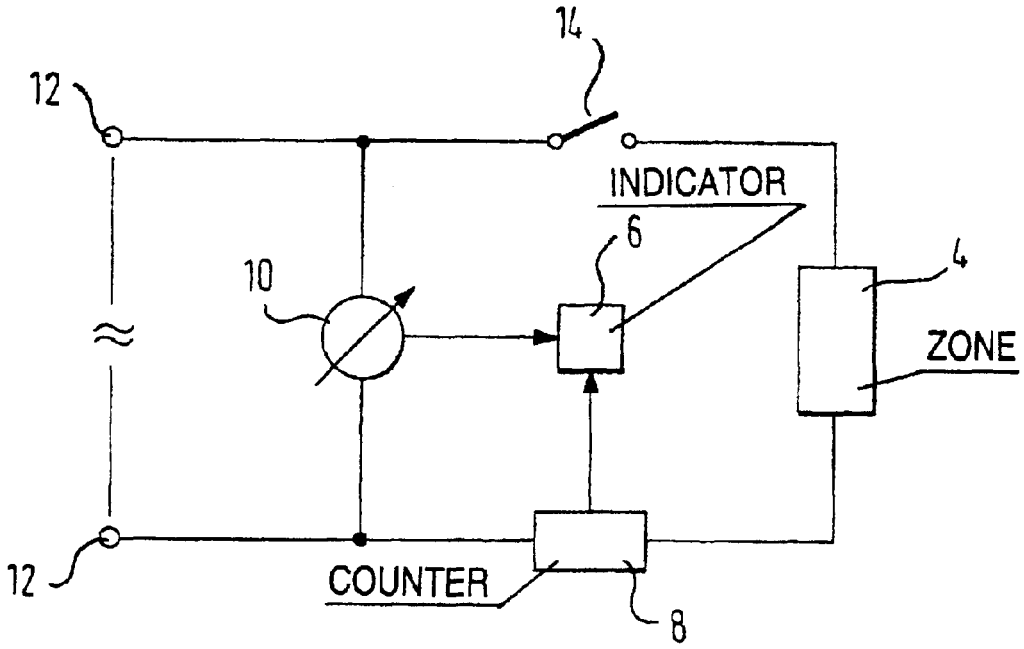
FIG. 2 is a simplified schematic circuit diagram of the oven according to FIG. 1.

As can be seen in FIG. 2, the cooking zones 4 with the associated heating elements, or the oven and the cooktop 2, are connected to a conventional AC voltage supply system, i.e., 230 volts, through a power-line connection 12. The heating elements of the cooking zones 4 can be switched on and their heating output controlled by a conventional control unit 14 of the oven in a way corresponding to the power preselections made by an operator by conventional setting elements of the oven. The control unit 14 may be, for example, a switching electronics unit with a microprocessor-based control. For the time-delayed switching-off of the residual heat indicator 6, a counter 8 is provided and coupled to the control unit 14 and the residual heat indicator 6. It is also possible, for example, for the counter 8 to be a component part of the microprocessor-based control. Also provided in the cooking appliance is a line voltage detector 10 that senses the line voltage present at the cooktop 2 through the power-line connection 12, or appliance-internal voltages derived therefrom. As a result, it is also possible to detect whether or not the cooking appliance is under line voltage. The line voltage detector 10, too, is coupled to the residual heat indicator 6, the counter 8, and the control unit 14. A voltage increase from zero to operating voltage can typically occur in two situations: during the first-time installation of the cooking appliance, when connecting the power-line connection 12 to the power supply system; and during the restoration of the power supply after a line voltage interruption or due to a power failure. If application of the line voltage to the cooking appliance is detected, a power failure warning signal is triggered.

The residual heat indicator 6 shows various indication contents, depending on the desired information content for the user. In a meaningful way, a residual heat of the already switched-off but still hot cooking zone 4 is represented by an uninterruptedly illuminated optical signal. In other words, as long as the residual heat indicator 6 is illuminated, the cooking zone 4 is still hot and should not be touched. A prior power failure, on the other hand, can be signaled by a regularly intermittent indication, whereby it can be ensured that the attention of the operator is attracted to an increased extent. At the same time, it is made clear to the operator by the flashing indication that the actual duration of residual heat may deviate from the duration of the flashing indication, because the counter 8 may have been set to a meaningful value, but not to a value corresponding to the actual duration of residual heat. Alternatively, instead of the flashing indication or in addition to this, additional acoustic warning signals may be output, further increasing the extent to which the attention of the operator is attracted. Moreover, switching-off of the power-failure warning signal can be made possible by providing a suitable non-illustrated button. Pressing such a button can have the effect of resetting the residual heat indicator 6.

According to one embodiment of the invention, the counter 8 can be incremented every time a cooking zone 4 is used for cooking, up to a maximum value, in dependence on the set cooking stage. After a predetermined time, a memory cell in an EEPROM of the counter 8, referred to as a residual heat flag, is set. After the switching-off of the cooking zone 4, the counter 8 is decremented. As long as the counter value is greater than zero, the residual heat indicator 6 is activated. After the duration of residual heat has elapsed, the residual heat indicator 6 is deactivated and the residual heat flag in the EEPROM is cleared. After a line voltage interruption, established by the line voltage detector 10, the residual heat flag in the EEPROM is inquired. If the residual heat flag is set, the counter 8 is preloaded with a meaningful value determined empirically in advance—that corresponds to a specific duration of residual heat. Moreover, the residual heat indicator 6 is switched over to the flashing and/or acoustic mode. The counter 8 is then decremented and the flag in the EEPROM is cleared.

In an alternative embodiment of the invention, the current reading of the counter 8 can be stored at regular intervals in the EEPROM. Such a variant preferably comes into consideration whenever the internal or external EEPROM used is suitable for a high number of write access operations. After a line voltage interruption, the counter 8 can be loaded with the value last stored in the EEPROM. If the counter reading is greater than zero, the residual heat indicator 6 is activated (flashing) and the counter 8 is decremented, until the calculated duration of residual heat ends. The duration of residual heat estimated in this way corresponds relatively exactly to the actually still present residual heat of the cooking zone 4.

The flashing indication and/or the additional acoustic signal have the effect of signaling to the operator that the duration of the indication does not necessarily correspond to the actual duration of residual heat.

A person skilled in the art will appreciate that the invention is not restricted to the exemplary embodiment represented, but likewise includes many variants and modifications.

I claim:

1. An electrical cooking appliance to be connected to a line voltage, comprising:

a cooktop having cooking zones becoming hot in a switched-on state;

at least one optical residual heat indicator indicating hot ones of said cooking zones when the line voltage is applied to the cooking appliance, said heat indicator connected to said cooking zones;

a counter having a memory storing at least one of a time delay value and a counter reading, said counter connected to said heat indicator, said counter being programmed to switch off said heat indicator at a time after said cooktop is switched off, said time being dependent upon said time delay value, said memory storing information as long as said counter reading is greater than zero;

a line voltage detector for detecting a presence of the line voltage at the cooking appliance; and said counter being programmed to activate, after a line voltage interruption, said heat indicator for a given period of time dependent upon a content of said memory if said information in said memory indicates said counter reading is greater than zero.

2. The electrical cooking appliance according to claim 1, wherein said line voltage detector is connected to said heat indicator and to said counter.

3. The electrical cooking appliance according to claim 1, wherein said memory stores at least two counter readings as long as said counter reading is greater than zero.

4. The electrical cooking appliance according to claim 1, wherein:

said heat indicator has a power failure warning signal; and a button is connected to said heat indicator for switching off said power failure warning signal.

5. The electrical cooking appliance according to claim 1, wherein said heat indicator outputs at least one of a visual signal and an acoustic signal after interruption of the line voltage.

6. An electrical cooking appliance to be connected to a line voltage, comprising:

a cooktop having cooking zones becoming hot in a switched-on state;

at least one optical residual heat indicator indicating hot ones of said cooking zones when the line voltage is applied to the cooking appliance, said heat indicator electrically connected to said cooking zones;

a counter system having a memory storing a time delay counter value, said counter system connected to said heat indicator, said counter system being programmed:

to switch off said heat indicator at a given time after said cooktop is switched off, said given time being dependent upon said counter value; and to decrement said counter value to zero, said memory storing information as long as said counter value is greater than zero;

a line voltage detector for detecting a presence of the line voltage at the cooking appliance, said line voltage detector electrically connected to said heat indicator and to said counter; and said counter system being programmed to activate, after a line voltage interruption, said heat indicator for a given period of time dependent upon a content of said memory if said information in said memory indicates said counter value is greater than zero.

7. The electrical cooking appliance according to claim 6, wherein said memory stores at least two counter readings as long as said counter value is greater than zero.

8. The electrical cooking appliance according to claim 6, wherein:

said heat indicator has a power failure warning signal; and a button is connected to said heat indicator for switching off said power failure warning signal.

9. The electrical cooking appliance according to claim 6, wherein said heat indicator outputs at least one of a visual signal and an acoustic signal after interruption of the line voltage.

10. In an electrical cooking appliance to be connected to a line voltage, the cooking appliance having a cooktop with cooking zones becoming hot in a switched-on state, an indicator system comprising:

at least one optical residual heat indicator indicating hot ones of said cooking zones when the line voltage is applied to the cooking appliance, said heat indicator electrically connected to said cooking zones;

a counter system having a memory storing a time delay counter value, said counter system connected to said heat indicator, said counter system being programmed:

to switch off said heat indicator at a given time after said cooktop is switched off, said given time being dependent upon said counter value; and to decrement said counter value to zero, said memory storing information as long as said counter value is greater than zero;

a line voltage detector for detecting a presence of the line voltage at the cooking appliance, said line voltage detector electrically connected to said heat indicator and to said counter system; and said counter system being programmed to activate, after a line voltage interruption, said heat indicator for a given period of time dependent upon a content of said memory if said information in said memory indicates said counter value is greater than zero.

11. The electrical cooking appliance according to claim 10, wherein said memory stores at least two counter readings as long as said counter value is greater than zero.

12. The electrical cooking appliance according to claim 10, wherein:

said heat indicator has a power failure warning signal; and a button is connected to said heat indicator for switching off said power failure warning signal.

13. The electrical cooking appliance according to claim 10, wherein said heat indicator outputs at least one of a visual signal and an acoustic signal after interruption of the line voltage.

14. A method of operating a residual heat indicator of an electrical cooking appliance, which comprises:

sensing a switched-on state of the cooking appliance;

sending a residual heat warning signal from the residual heat indicator as long as the cooking appliance has a line voltage applied;

establishing a delay interval value with a counter system;

after switching-off the cooking appliance connected to the line voltage, switching off the residual heat indicator with the counter system at a later point in time dependent upon the delay interval value;

detecting a presence of the line voltage at the cooking appliance with a line voltage detector;

decrementing the delay interval value with the counter system;

storing information in a memory of the counter system as long as the delay interval value is greater than zero; and after interruption of the line voltage, maintaining activation of the residual heat indicator as long as the delay interval value is greater than zero.

15. The method according to claim 14, which further comprises storing at least two counter readings in the memory as long as the delay interval value is greater than zero.

16. The method according to claim 15, which further comprises:

storing the counter readings in the memory at regular intervals; and after interruption of the line voltage, using the counter readings for at least one of:

a time-delayed switching-off of the residual heat indicator; and outputting a power failure warning signal.

17. The method according to claim 14, which further comprises:

storing a residual heat flag in an EEPROM of the memory, the residual heat flag having two different states; and after the delay interval value is decremented to zero, deactivating the residual heat indicator and clearing the residual heat flag.

18. The method according to claim 17, which further comprises:

after interruption of the line voltage, the counter system:

inquiring the residual heat flag;

preloading a given value; and clearing the residual heat flag after the delay interval value is decremented to zero.

19. The method according to claim 17, which further comprises:

storing the delay interval value at regular intervals in the EEPROM;

after interruption of the line voltage, examining the delay interval value in the EEPROM and reinitializing the delay interval value dependent upon the stored delay interval value.

20. The method according to claim 14, which further comprises:

storing a residual heat flag in an EEPROM of the memory, the residual heat flag having two different states; and after a shutoff delay interval has elapsed, deactivating the residual heat indicator and clearing the residual heat flag.

21. The method according to claim 20, which further comprises:

after interruption of the line voltage, the counter system:

inquiring the residual heat flag;

preloading a given value; and clearing the residual heat flag after a shutoff delay interval has elapsed.

22. The method according to claim 20, which further comprises:

storing the delay interval value at regular intervals in the EEPROM;

after interruption of the line voltage, examining the delay interval value in the EEPROM and reinitializing the delay interval value dependent upon the stored delay interval value.

23. The method according to claim 14, which further comprises outputting a flashing signal with the residual heat indicator after interruption of the line voltage.

24. The method according to claim 14, which further comprises outputting an acoustic signal with the residual heat indicator after interruption of the line voltage.

25. The method according to claim 14, which further comprises switching off the residual heat indicator after a renewed switching-on of the cooking appliance occurs.

* * * * *